US006835171B2

(12) United States Patent
Unger et al.

(10) Patent No.: US 6,835,171 B2
(45) Date of Patent: Dec. 28, 2004

(54) CENTRIFUGE AND CONTAINER SYSTEM FOR TREATMENT OF BLOOD AND BLOOD COMPONENTS

(75) Inventors: Peter Unger, Stockholm (SE); Eric Westberg, Lidingö (SE)

(73) Assignee: Gambro Inc, Lakewood, CO (US)

( * ) Notice: Subject to any disclaimer, the term of this patent is extended or adjusted under 35 U.S.C. 154(b) by 0 days.

(21) Appl. No.: 10/759,767

(22) Filed: Jan. 16, 2004

(65) Prior Publication Data

US 2004/0147387 A1 Jul. 29, 2004

Related U.S. Application Data

(63) Continuation of application No. 10/054,484, filed on Jan. 22, 2002, now Pat. No. 6,689,042, which is a continuation of application No. 09/355,930, filed as application No. PCT/SE98/00246 on Feb. 12, 1998, now Pat. No. 6,348,031.

(30) Foreign Application Priority Data

Feb. 12, 1997 (SE) ..... 9700495

(51) Int. Cl.[7] ..... B04B 15/00

(52) U.S. Cl. ..... 494/27; 494/43; 494/45; 494/76; 604/410

(58) Field of Search ..... 494/16, 17, 23, 494/27, 28, 43, 45, 60, 63, 76; 210/360.1, 512.1, 781, 782, 787, 789; 604/410

(56) References Cited

U.S. PATENT DOCUMENTS

| | | | | |
|---|---|---|---|---|
| 3,326,458 A | | 6/1967 | Meryman et al. | |
| 3,679,128 A | | 7/1972 | Unger et al. | |
| 3,708,110 A | | 1/1973 | Unger et al. | |
| 3,724,747 A | | 4/1973 | Unger et al. | |
| 3,737,096 A | | 6/1973 | Jones et al. | |
| 3,858,796 A | | 1/1975 | Unger et al. | |
| 3,987,961 A | * | 10/1976 | Sinn et al. | 494/45 |
| 4,389,207 A | | 6/1983 | Bacehowski et al. | |
| 4,405,079 A | | 9/1983 | Schoendorfer | |
| 4,421,503 A | | 12/1983 | Latham, Jr. et al. | |
| 4,439,177 A | | 3/1984 | Conway | |
| 4,482,342 A | | 11/1984 | Lueptow et al. | |
| 4,720,284 A | | 1/1988 | McCarty | |
| 4,950,401 A | * | 8/1990 | Unger et al. | 210/360.1 |
| 4,990,132 A | | 2/1991 | Unger et al. | |
| 5,114,396 A | | 5/1992 | Unger et al. | |
| 5,632,906 A | | 5/1997 | Ishida et al. | |
| 5,723,050 A | | 3/1998 | Unger et al. | |
| 5,874,208 A | | 2/1999 | Unger | |
| 6,261,217 B1 | | 7/2001 | Unger et al. | |
| 6,315,706 B1 | | 11/2001 | Unger et al. | |
| 6,348,031 B1 | | 2/2002 | Unger et al. | |
| 6,656,105 B2 | | 12/2003 | Hogberg et al. | |
| 6,689,042 B2 | * | 2/2004 | Unger et al. | 494/45 |
| 6,740,239 B2 | | 5/2004 | Hogberg et al. | |

FOREIGN PATENT DOCUMENTS

| | | |
|---|---|---|
| WO | WO92/00145 | 1/1992 |
| WO | WO03/089027 | 10/2003 |

* cited by examiner

*Primary Examiner*—Joseph Drodge
(74) *Attorney, Agent, or Firm*—Edna M. O'Connor

(57) ABSTRACT

A centrifuge is provided for the separation and/or treatment of cells in a substantially annular or partially annular separation bag connected by at least one tube to at least one secondary bag. The centrifuge comprises a rotor bowl connected at the upper end of a rotor shaft. The rotor shaft includes a hollow upper portion defining a central compartment for receiving the at least one secondary bag. The rotor bowl includes a separation compartment for receiving the separation bag and an expandable hydraulic chamber located within the separation compartment for selectively squeezing the separation bag within the separation compartment so as to transfer a separated component from the separation bag into a secondary bag in the central compartment. A hydraulic system is connected to the hydraulic chamber by a duct extending through the rotor shaft for pumping a hydraulic liquid to and from the hydraulic chamber.

23 Claims, 4 Drawing Sheets

CENTRIFUGE AND CONTAINER SYSTEM FOR TREATMENT OF BLOOD AND BLOOD COMPONENTS

This application is a continuation of U.S. patent application Ser. No. 10/054,484 filed on 22 Jan. 2002, now U.S. Pat. No. 6,689,042, which is a continuation of U.S. patent application Ser. No. 09/355,930 filed on 12 Aug. 1999, now U.S. Pat. No. 6,348,031, which is the National Stage of International PCT Application No. PCT/SE98/00246 filed on 12 Feb. 1998, which claims the priority of Swedish Patent Application No. 9700495-6 filed on 12 Feb. 1997.

BACKGROUND OF THE INVENTION

1. Field of the Invention

The invention relates to a centrifuge for separation and/or treatment of blood or blood components, comprising a rotor having a central compartment and an annular separation compartment, which are arranged concentrically with the axis of rotation of the rotor and are adapted to accommodate a container system comprising a round bag and one or more secondary containers connected thereto, the separation compartment being adapted to accommodate the round bag and the central compartment being adapted to accommodate the secondary containers, and the centrifuge further comprising means for reducing, in operation, the volume of the separation compartment in order to displace a separated fraction from the round bag to a secondary container in the central compartment.

The invention also relates to a container system to be arranged in the centrifuge according to the invention.

2. Description of the Related Art

By round bag is below meant an essentially annular flexible container, which can be produced, for instance, by welding together superimposed plastic films along an outer annular edge and an inner annular edge. The annular container can, in the same way as described in WO 95/01842, be cut off and the thus-formed opposite ends sealed. These opposite ends are arranged in an overlapping manner when the round bag is mounted in the centrifuge or on a cassette, thereby giving the round bag the shape of a truncated cone.

U.S. Pat. No. 5,114,396 discloses a method and a container system for washing blood cells by using a centrifuge of the type mentioned by way of introduction. In this prior-art container system, use is made of the central part inside the round bag as a secondary container, and a continuous unit is obtained, which essentially is oriented in a horizontal plane. When large volumes of liquid are to be handled in the secondary containers, this container system requires a large rotor diameter.

International Patent Application WO 95/01842 discloses a container system which in a corresponding manner utilises the central part inside the round bag as a secondary container. In this case, the round bag is shortened by letting two opposite sealed ends of the ring overlap in connection with the mounting of the round bag on a rigid centre part, thereby obtaining the shape of a truncated cone. The secondary container is pressed into a cavity in the rigid centre part. The cavity has a smaller diameter than the secondary container, and its radially outer parts are folded along the walls of the cavity. In this way, the entire system obtains a small diameter and can be accommodated in a correspondingly small rotor. Especially when separating sensitive cell suspensions, e.g. platelets, this system has great advantages since the separation must be effected with a certain amount of caution and the cell suspension is not allowed to be exposed to high G fields for long periods. However, the system is suited above all for separations where the secondary containers are initially empty and can easily be mounted in a deformed state in the cavity.

SUMMARY OF THE INVENTION

An object of the present invention is to provide a centrifuge of the type mentioned by way of introduction, which has a compact size and can easily be used for various types of separations by means of different container systems in the form of cassettes. Thus, the centrifuge can be used for separations and treatments where large amounts of liquid are to be handled in secondary containers, for instance in connection with the washing of cells, as well as for separations of the type described in WO 95/01842. Further objects and advantages of the invention will be apparent from the following specification.

The inventive centrifuge is characterised in that the central compartment is a tubular shaft cavity in the centre of the rotor, and that the annular separation compartment is arranged around the cavity at the upper part thereof.

By this design of the rotor, large volumes of liquid in secondary containers can be held in the central compartment and the diameter of the rotor can still be made relatively small. The rotor obtains good balance by the placing of the liquids in the shaft cavity close to the axis of rotation of the rotor. Preferably the separation compartment has a conical shape and is inclined obliquely downwards or obliquely upwards, which further reduces the diameter of the rotor and expedites the separation through the inclined separation compartment.

The rotor is adapted to accommodate a container system comprising a tubular sleeve which is adapted to the shaft cavity of the rotor and on which the round bag is mounted and in which the secondary container/containers are arranged.

A first container system according to the invention, for separation and/or treatment of blood or blood components, adapted to placed in the centrifuge, is characterised by a round bag which has an outer annular edge and an inner annular edge; two or more flexible secondary containers, of which at least one contains a treatment liquid; a tube system connecting the round bag with the secondary containers; a tubular sleeve which is adapted to the shaft cavity of the rotor and which is adapted to accommodate the secondary containers standing side by side and resting against each other, and which at its upper part comprises a projecting flange, and in that the round bag, by means of its inner edge, is adapted to be mounted on said flange.

This container system is in the first place intended for separations and treatments comprising the handling of relatively large volumes of liquid in the secondary containers, for instance, when washing blood cells. In washing, use is made of one or more secondary containers containing washing liquid (washing liquid container) and an initially empty secondary container (waste liquid container) which is adapted to receive waste liquid which is displaced from the round bag after a completed washing step. The total volume of liquid in the secondary containers may constitute 2–3 liters. Thanks to the flexible secondary containers which rest against each other, the space is maximally utilised. In the course of the process, the volume of washing liquid in the washing liquid container decreases and increases to the same extent in the waste liquid container.

The container system is also suited for other types of separations and treatments which involve liquids in secondary containers, for instance, treating, reconditioning and preserving liquids, which at some stage of the process are transferred to other bags in the system to be mixed with a blood component therein. Even if use is not made of all bags during the actual centrifugation process, they must be loaded into the centrifuge since the containers normally constitute an interconnected sterile unit that should not be disconnected and be connected again.

A second container system according to the invention to be inserted in the centrifuge is characterised by a round bag having an outer annular edge and an inner annular edge; a secondary container; a tube connecting the round bag with the secondary container; a tubular sleeve which is adapted to accommodate the secondary container and which has a smaller diameter than the shaft cavity of the rotor and on its outside has support elements which are adapted to engage the walls of the cavity and centre the sleeve in the centre of the cavity, and at its upper part has a projecting flange, and in that the round bag by means of its inner edge is adapted to be mounted on said flange.

This container system makes it possible to use the same centrifuge also when relatively small volumes of liquid are to be handled in a secondary container in the central shaft cavity of the rotor, for instance, when only one initially empty container is arranged in the sleeve to receive a separated component from the round bag while the centrifugation proceeds.

BRIEF DESCRIPTION OF THE DRAWINGS

The invention will now be described in more detail with reference to the accompanying Figures.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
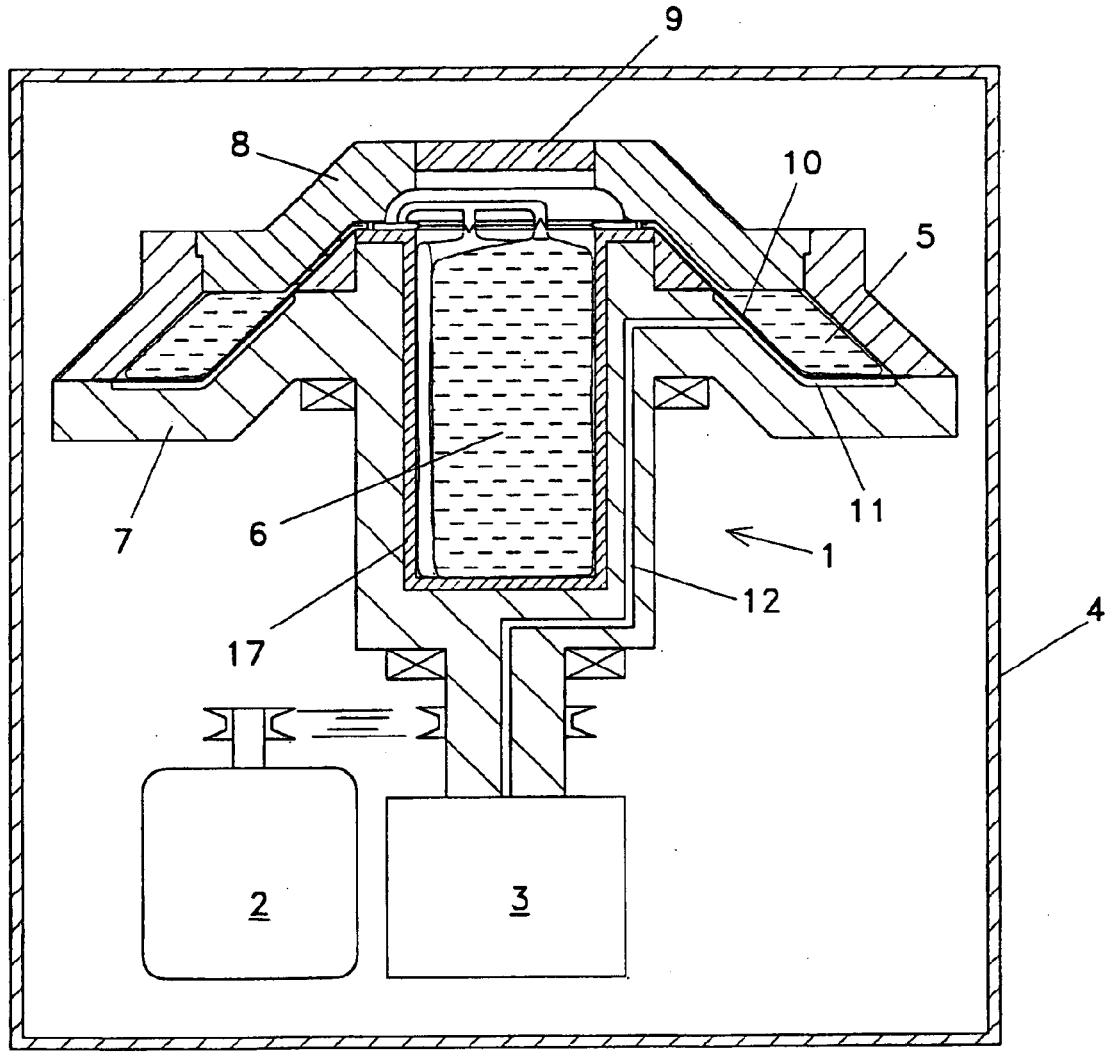
FIG. 1 shows a section of an embodiment of a centrifuge according to the invention with a first container system inserted.

The centrifuge according to FIG. 1 comprises a rotor 1 and its associated auxiliary equipment such as a drive system 2, a hydraulic system 3 and a control system for the operation of the centrifuge (not shown), which is accommodated in an apparatus housing 4. The auxiliary equipment and the apparatus housing have been indicated schematically only.

The rotor has, concentrically with the axis of rotation of the rotor, an annular separation compartment 5 and a central tubular shaft cavity 6. The cavity 6 is relatively deep and narrow and extends vertically down in an enlarged rotor shaft. The rotor bowl 7 itself, which accommodates the separation compartment 5, surrounds the cavity at the upper part thereof. A removable rotor lid 8 closes the separation compartment and the cavity and can in its central part be provided with a window 9 which permits inspection and photocell monitoring. The separation compartment has a conical shape and is inclined obliquely downwards, which results in a more rapid separation and reduces the diameter of the rotor compared with a horizontally oriented compartment.

In the base of the separation compartment a flexible membrane 10 is arranged, which is clamped against the rotor bowl and defines a hydraulic compartment 11. Thanks to the hydraulic system 3, a hydraulic liquid can be pumped through a duct 12 in the rotor shaft to the hydraulic compartment 11, the membrane 10 being expanded and reducing the volume of the separation compartment.

The rotor is specifically adapted to accommodate a container system in the form of a cassette comprising a tubular sleeve 17, which is adapted to the shaft cavity of the rotor and on which the round bag 13 is mounted and in which the secondary container/containers are arranged. Two different container systems to be inserted in the rotor are described in connection with FIGS. 3–7.

Figure 2:
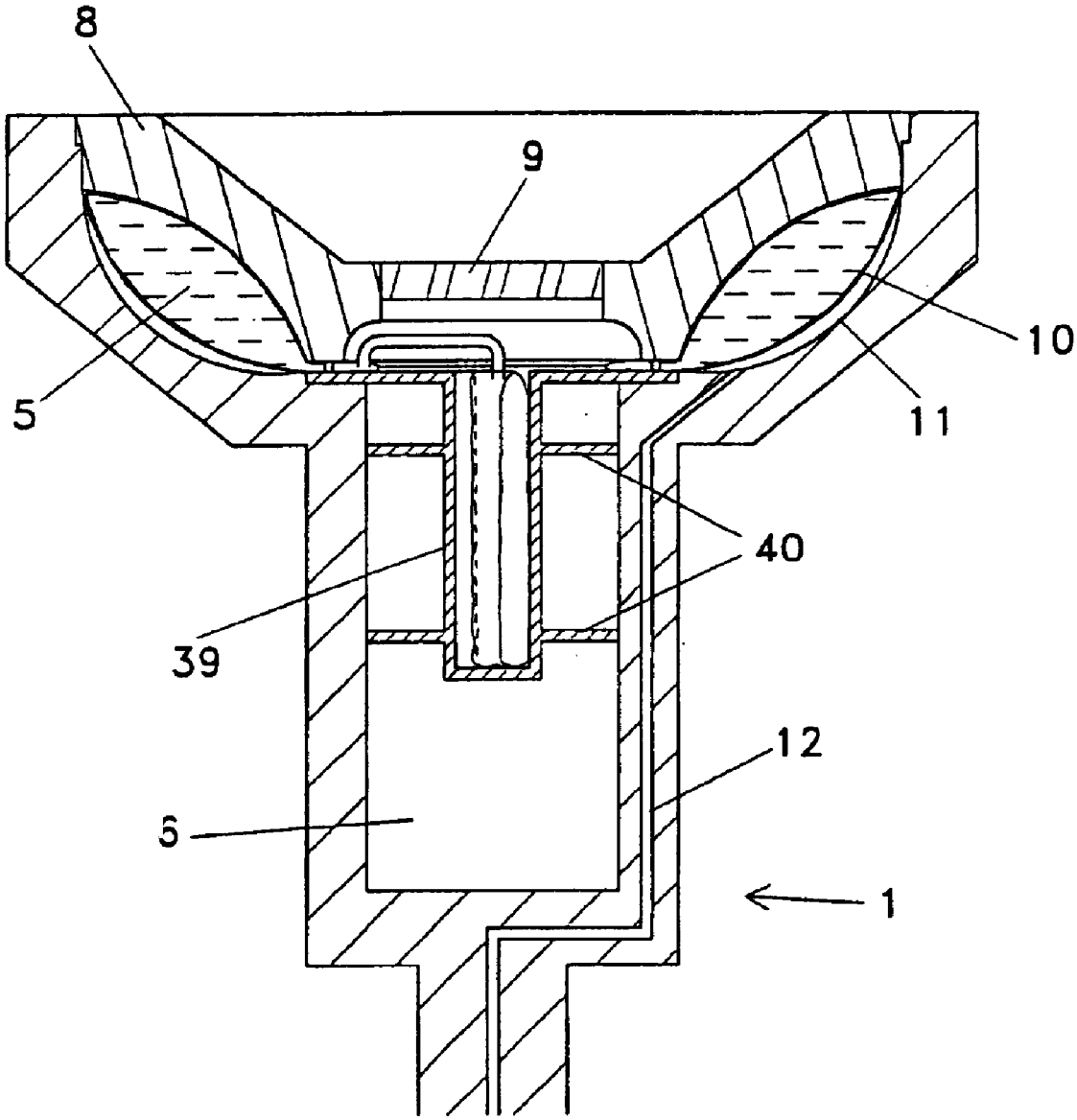
FIG. 2 shows a section of an alternative embodiment of a centrifuge according to the invention with a second container system inserted.
Figure 7:
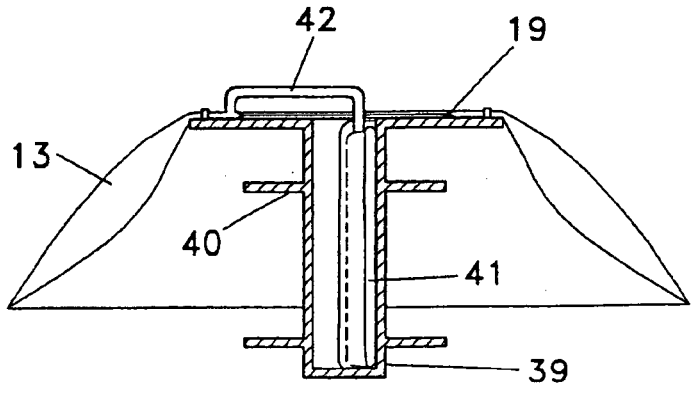
FIG. 7 shows a section of an alternative container system according to the invention.

FIG. 2 shows an alternative embodiment of the centrifuge rotor according to the invention. Equivalent components in the different Figures have been given the same reference numerals. In the same way as in FIG. 1, the separation compartment 5 has a conical shape, but is in this case angled upwards. The separation compartment also has a more elliptic cross-section than the variant shown in FIG. 1. A container system of the type which is described in more detail in connection with FIG. 7 is shown when arranged in the rotor. The rotor can, like the rotor in FIG. 1, be provided with the one or the other type of container system.

Figure 3:
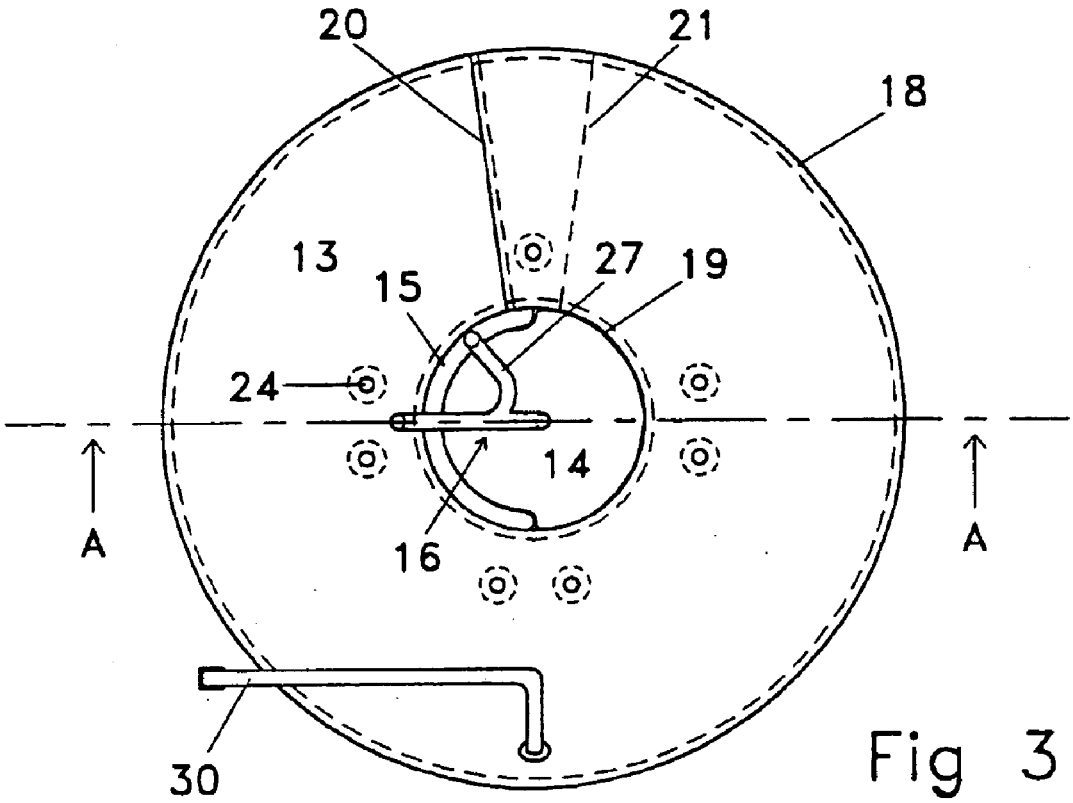
FIG. 3 is a top plan view of a container system according to the invention.
Figure 4:
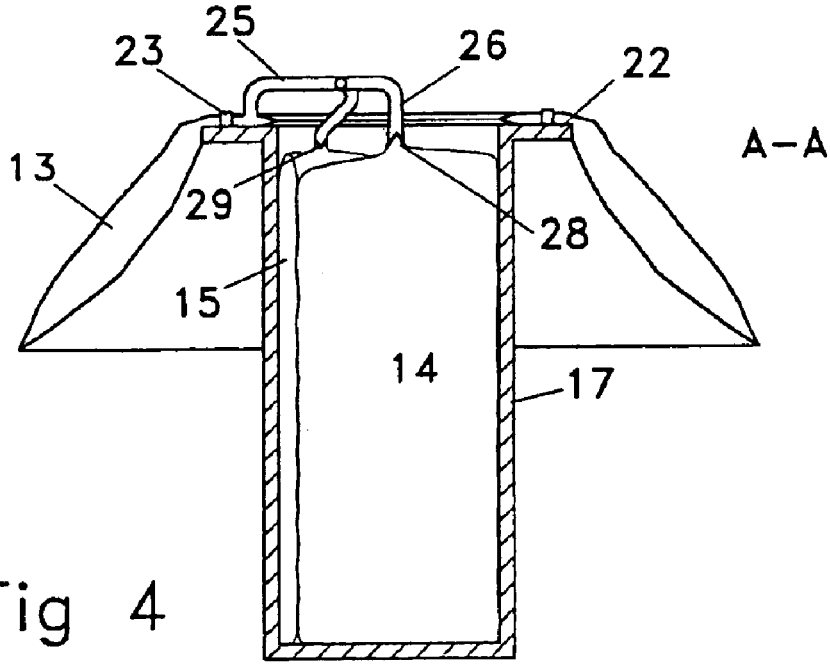
FIG. 4 shows a section A—A of the container system according to FIG. 3.

FIGS. 3 and 4 illustrate a container system according to the invention to be arranged in the centrifuge. FIG. 3 is a top plan view of the container system, and FIG. 4 shows a section A—A. The container system consists of a round bag 13, flexible secondary containers 14, 15, a tube system 16 connecting the round bag with the secondary containers, and a sleeve 17, in which the secondary containers are arranged standing side by side and resting against each other. The round bag 13 can be made by two plastic films, arranged one above the other, being welded together along an outer annular edge 18 and an inner annular edge 19. In the example shown, the annular container 13 is cut off, and the opposite ends 20 and 21 so formed are sealed and made to overlap one another, whereby the round bag obtains a conical shape in the same way as described in WO 95/01842. The welds of the round bag have been indicated by a dashed line inside the respective edge lines. The container system as shown is intended for washing blood cells and comprises two secondary containers, of which one is a washing liquid container 14 containing a washing liquid, e.g. a sterile aqueous solution of NaCl (0.9%) and glucose (0.2%), and the other is a waste container 15 which is initially empty. The sleeve 17 is adapted to be lowered into the shaft cavity 6 of the rotor (FIGS. 1 and 2) and may be made of, for instance, a plastic material which is sufficiently rigid to make the container system easy to handle. The sleeve has in its upper part a projecting flange 22, on which the round bag is mounted by means of its inner edge 19. The flange is provided with pins 23, which fit in corresponding holes 24 in welded-together portions of the round bag. The round bag is adapted to be accommodated by the annular separation compartment 5 of the rotor. The tube system 16 consists in the example shown of a tube 25 which is connected to the round bag close to the inner edge 19 thereof and which branches into a tube branch 26 which is connected to the washing liquid container 14, and a tube branch 27 which is connected to the waste container 15. The tube branch 26 is provided with a one-way valve 28, which allows only liquid flow from the washing liquid container to the round bag, and the tube branch 27 is provided with a one-way valve 29, which allows only liquid flow from the round bag to the waste container. The valves are normally closed and require a certain liquid pressure to open. Instead of these one-way valves, the tubes can be placed in pinch valves which are controlled by an automatic programme control in the centrifuge. The round bag is also provided with a tube 30, through which the blood cells are supplied to be washed or drawn off after washing.

The secondary containers are designed to be able to expand in the radial direction, such that each of them can fill the inner diameter of the sleeve and, in all positions, yields good rotor balance. In centrifugation, the liquid in the secondary containers is pressed against the walls of the sleeve and the flexible containers must be able to adapt to this distribution of liquid.

When washing cells that have been treated according to the high glycerol method, the initial washing steps must be carried out with a washing liquid of a higher salt concentration, in which case the sleeve 17 is correspondingly provided with three secondary containers, one of which is a washing liquid container containing a hypertonic salt solution and one is a washing liquid container containing a physiological salt solution.

The sleeve can in a corresponding manner be provided with, for instance, an empty secondary container which is adapted to receive a separated component from the round bag, and a secondary container which contains, for instance, a preservation liquid which after completion of the separation is supplied to the round bag and is mixed with a component remaining therein.

Figure 5:
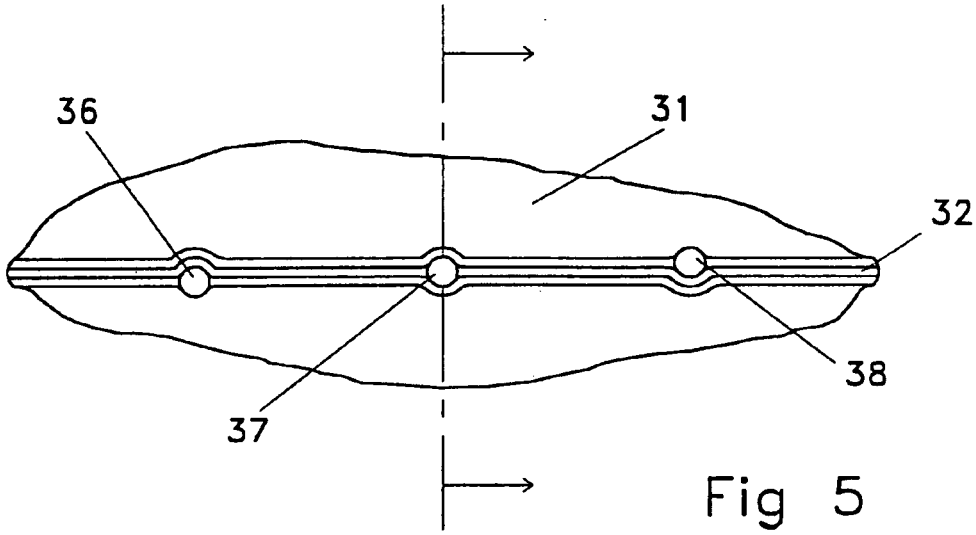
FIG. 5 is a top plan view of a multiple bag.
Figure 6:
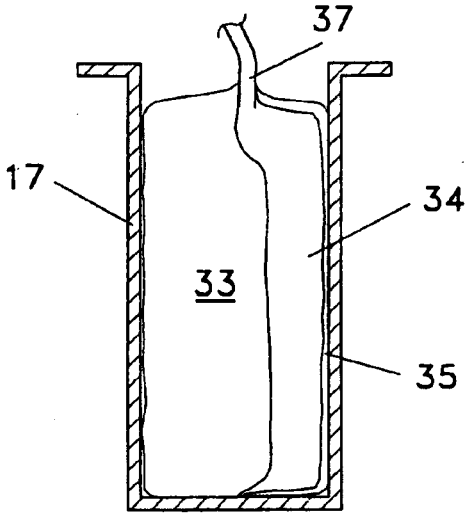
FIG. 6 shows a section of a multiple bag according to FIG. 5, arranged in a sleeve and filled with liquid in two containers.

The secondary containers may consist of a multiple bag which is made by putting together and welding together a number of plastic films along the circumference, thereby forming containers between the films. Tube connections to the different spaces between the films are arranged in one edge of the multiple bag. FIGS. 5 and 6 illustrate an embodiment of a multiple bag 31 which is made by four joined film layers 32 and which thus comprises three containers 33, 34 and 35 adjoining each other. FIG. 5 is a top plan view of the multiple bag with tube connections 36, 37 and 38 between the different film layers. FIG. 6 is a section of the multiple bag, two of the containers being filled with liquid and the multiple bag being arranged standing in a sleeve 17. For instance, the container 33 can be a washing liquid container containing a physiological salt solution, the container 34 can be a washing liquid container containing a hypertonic salt solution, and the container 35 can be a waste container.

The function of the centrifuge and the container system will be described below with reference to FIG. 1, the carrying out of the washing of blood cells being taken as an example. A container system of the type as shown in FIGS. 3 and 4 is used, one secondary container 14 containing washing liquid (washing liquid container), and the other 15 being initially empty (waste container). A batch of red blood cells that has been frozen and is mixed with glycerol is transferred to the round bag via a tube 30. The container system is arranged in the rotor 1, and the rotor lid 8 is put on and locked. The centrifuge is operated for a predetermined period at a certain speed, whereby the major part of the glycerol is separated from the cells. The glycerol constitutes the lighter fraction and is collected adjacent to the centre of rotation against the inner edge 19 of the round bag. With a reduced speed of the rotor, a predetermined volume of hydraulic fluid is pumped via the duct 12 to the hydraulic compartment 11, the membrane 10 being pressed into the separation compartment 5 and reducing its volume. The corresponding volume of glycerol is now pressed via the tube 25 and the tube branch 27 to the waste container 15. The liquid pressure opens the one-way valve 29. Subsequently, the hydraulic pump is reversed and the same volume of hydraulic liquid as was previously pumped in is now sucked out of the hydraulic compartment 11, the corresponding volume of washing liquid being sucked via the tube branch 28 and the tube 25 to the round bag. By reversals of the direction of rotation of the rotor, the washing liquid is mixed with the cells. Then the separation process is repeated, the consumed washing liquid being displaced to the waste container 15 and new washing liquid being sucked into the round bag. The washing cycle is repeated until the washing liquid is used up, and the cells are, according to calculations, sufficiently cleaned from glycerol. The last batch of washing liquid is not separated but is used to resuspend the cells to a retransfusable form, and the cell slurry is transferred to a blood bag. During the centrifuging steps, the total volume of liquid in the sleeve 17 in the shaft cavity 6 of the rotor is constant since, in each step, the same volume of liquid is supplied to the waste container 15 as is drawn off from the washing liquid container 14. The two secondary containers are made in such a manner that they are able to expand over the entire inner diameter of the sleeve, and the one container successively takes over the space of the other container during the process owing to their resting against each other. The rotor obtains good equilibrium, and it is possible to avoid great stresses and the risk of breaking of the secondary containers.

FIG. 7 shows a section of a container system for separating blood components, which can be used in the same centrifuge as the system described above if only a small volume of liquid is to be held in the secondary container. Particularly, the container system is intended to be used when only one separated component is to be received from the round bag. The container system differs from what has been described above in connection with FIGS. 3 and 4 by the tubular sleeve 39 having in this case a smaller diameter than the shaft cavity 6 of the rotor and having on its outside support elements 40 which are adapted to engage the walls of the cavity and centre the sleeve in the centre of the cavity. The Figure shows an empty secondary container 41 standing in the sleeve 39. A tube 42 connects the secondary container with the round bag and connects at a point adjacent to the inner edge 19 of the round bag. The secondary container has a width which approximately corresponds to the inner circumference of half the sleeve and is arranged standing along the sleeve wall as shown in the Figure. When being filled with liquid, it expands to a cylindrical shape which occupies the entire diameter of the sleeve. In the same way as described in connection with FIGS. 3–4, the round bag 13 can be made conical by letting sealed opposite ends of the ring overlap. The conical angle can be directed upwards or downwards. FIG. 2 shows the container system mounted in a rotor, in which case a conical upward angling is used.

The container system is specifically suited for separations of sensitive cell suspensions which should not be exposed to high G fields for long periods. This is the case, for instance, when separating a thrombocyte suspension from combined buffycoat fractions from previous three-component separations of whole blood. A small rotor diameter and a secondary container which is centred at the axis of rotation of the rotor then constitute a great advantage. The construction of the centrifuge allows the secondary container and its sleeve to be made high and narrow and be centred in a very low G field. The secondary container is suitably formed of a plastic film quality which is particularly suitable for storing a thrombocyte suspension. Such plastic films are known and designed to yield the necessary gas permeability etc.

The invention being thus described, it will be apparent that the same may be varied in many ways. Such variations are not to be regarded as a departure from the spirit and the scope of the invention, and all such modifications as would be recognized by one skilled in the art are intended to be included within the scope of the following claims.

What is claimed is:

1. A centrifuge for the separation and/or treatment of cells in a substantially annular or partially annular separation bag connected by at least one tube to at least one secondary bag, comprising:

a rotor including:

a rotor shaft having:

a rotation axis, and a hollow upper portion defining a central compartment extending around the rotation axis and having an upper opening for receiving the at least one secondary bag;

a rotor bowl connected to the rotor shaft so as to be centred with respect to the rotation axis, and connected to the hollow upper portion of the rotor shaft and having:

a separation compartment for receiving the separation bag, and an expandable hydraulic chamber located within the separation compartment for selectively squeezing the separation bag within the separation compartment so as to transfer a separated component from the separation bag into a secondary bag in the central compartment;

a hydraulic system connected to the hydraulic chamber by a duct extending through the rotor shaft for pumping a hydraulic liquid to and from the hydraulic chamber.

2. The centrifuge according to claim 1, further comprising:

pinch valves for the at least one tube connecting the separation bag to the at least one secondary bag.

3. The centrifuge according to claim 2, further comprising:

an automatic programmed control system for controlling the pinch valves.

4. The centrifuge according to claim 1, wherein the expandable hydraulic chamber comprises:

a flexible membrane secured to the rotor bowl.

5. The centrifuge according to claim 1, wherein the separation compartment further comprises:

a frusto-conical support surface for supporting the separation bag.

6. The centrifuge according to claim 5, wherein the frusto-conical support surface of the separation compartment flares from the hollow upper portion of the rotor shaft below the opening of the central compartment.

7. The centrifuge according to claim 5, wherein the frusto-conical support surface of the separation compartment flares from the hollow upper portion of the rotor shaft above the opening of the central compartment.

8. The centrifuge according to claim 1 for the separation and/or treatment of cells in a container system comprising:

the substantially annular or partially annular separation bag;

the at least one secondary bag;

the at least one tube connecting the separation bag to the at least one secondary bag; and a container for receiving the at least one secondary bag and designed to removably fit within the central compartment defined by the hollow upper portion of the rotor shaft of the centrifuge.

9. A container system for the separation and/or treatment of cells in a centrifuge according to claim 1, wherein the container system comprises:

the substantially annular or partially annular separation bag having:

an outer periphery and an inner periphery;

the at least one secondary bag;

the at least one tube connecting the separation bag to the at least one secondary bag;

an oblong container having:

an upper portion surrounding an upper opening, wherein the container is designed for receiving the at least one secondary bag in a substantially upright position and to removably fit within the central compartment defined by the hollow upper portion of the rotor shaft of a centrifuge, and wherein the separation bag is removably secured to the upper portion of the container by an area thereof adjacent its inner periphery.

10. The container system according to claim 9, wherein the container further comprises a sleeve having a flange extending outwardly at an upper portion thereof.

11. The container system according to claim 10, wherein the sleeve is made of a rigid plastic material.

12. The container system according to claim 10, wherein the sleeve directly fits within the central compartment.

13. The container system according to claim 10, wherein the sleeve fits within the central compartment through spacing elements that keeps the sleeve centred about a central axis of the central compartment.

14. The container system according to claim 10, wherein the separation bag is secured to the flange of the container by an area thereof adjacent its inner periphery.

15. The container system according to claim 10, wherein the separation bag further comprises:

holes in an area adjacent its inner periphery; and the container further comprises:

pins protruding from an upper surface of the flange for fitting the holes of the separation bag.

16. The container system according to claim 10, comprising at least two secondary bags formed by stacked sheets of flexible plastic material that are welded together at a periphery thereof.

17. The container system according to claim 10, further comprising:

a first secondary bag connected to the separation bag by a tube including:

a one-way valve allowing a flow of liquid from the first secondary bag to the separation bag, and a second secondary bag connected to the separation bag by a tube including:

a one-way valve allowing a flow of liquid from the separation bag to the second secondary bag.

18. The container system according to claim 10, wherein the at least one tube is connected to the separation bag at the inner periphery thereof.

19. The container system according to claim 10, wherein the at least one tube comprises:

a portion of tube having a first end connected to the separation container and a second end that branches into a first tube portion connected to a first secondary bag and a second tube portion connected to a second secondary bag.

20. The container system according to claim 10, further comprising:

a first secondary bag containing a washing liquid and a second secondary bag intended to receive a waste liquid.

21. The container system according to claim 10, wherein the at least one secondary bag is made of a plastic material that is suited for storing a thrombocyte suspension.

22. A centrifuge for the separation and/or treatment of cells in a substantially annular or partially annular separation bag connected by at least one tube to at least one secondary bag, comprising:

a rotor including:

a rotor shaft having:

a rotation axis, and a hollow upper portion defining an oblong central compartment extending around the rotation axis and having an upper opening for receiving the at least one secondary bag in a substantially upright position;

a rotor bowl connected to the rotor shaft so as to be centred with respect to the rotation axis, and connected to the hollow upper portion of the rotor shaft and having a separation compartment for receiving the separation bag having:

a frusto-conical support surface for supporting the separation bag, wherein the support surface flares from the upper opening of the central compartment.

23. A container system for the separation and/or treatment of cells in a centrifuge, wherein the container system comprises:

a separation bag;

a first secondary bag;

a second secondary bag;

at least one tube connecting the separation bag to the at least one first and second secondary bags, the at least one tube comprising:

a first tube portion having a first end connected to the separation container and a second end;

a second tube portion having a first end connected to the second end of the first tube portion and a second end connected the first secondary bag; and a third tube portion having a first end connected to the second end of the first tube portion and a second end connected the second secondary bag, and a container having a sleeve for receiving the first and second secondary bags in a substantially upright position and designed to removably fit within the central compartment defined by the hollow upper portion of the rotor shaft of a centrifuge.

* * * * *